United States Patent [19]

Hesterlee

[11] 4,421,304

[45] Dec. 20, 1983

[54] APPARATUS FOR CONTROLLED TEMPERATURE ACCUMULATOR FOR ELONGATED MATERIALS

[75] Inventor: Jerry M. Hesterlee, Carrollton, Ga.

[73] Assignee: Southwire Company, Ga.

[21] Appl. No.: 332,991

[22] Filed: Dec. 21, 1981

[51] Int. Cl.[3] ..... C21D 9/56

[52] U.S. Cl. ..... 266/103; 148/156; 432/59; 72/289

[58] Field of Search ..... 266/102, 103, 104, 106, 266/90, 92; 148/156; 432/8, 59, 48; 226/38, 195; 72/286, 280, 289; 242/157 R

[56] References Cited

U.S. PATENT DOCUMENTS

| | | | |
|---|---|---|---|
| Re. 28,419 | 5/1975 | Schoeiner | 148/2 |
| Re. 30,465 | 12/1980 | Schoeiner | 428/606 |
| 1,607,675 | 11/1926 | Jefferies | 219/10.41 |
| 2,040,343 | 5/1936 | Simons et al. | 219/10.41 |
| 2,309,745 | 2/1943 | Bergin | 148/6.14 R |
| 2,589,283 | 3/1952 | O'Grady | 219/155 |
| 2,622,860 | 12/1952 | Lorig | 432/8 |
| 2,965,368 | 12/1960 | McIlvried | 148/156 |
| 3,045,094 | 7/1962 | Coscia et al. | 219/10.41 |
| 3,152,442 | 10/1964 | Nye et al. | 148/144 |
| 3,418,177 | 12/1968 | Pryor | 148/11.5 R |
| 3,486,947 | 12/1969 | Pryor et al. | 148/11.5 A |
| 3,512,221 | 5/1970 | Schoeiner | 428/606 |
| 3,670,401 | 6/1972 | Schoeiner | 164/160.2 |
| 3,857,673 | 12/1974 | Andrus | 432/59 |
| 3,964,935 | 6/1976 | Wilks | 148/2 |
| 3,967,983 | 7/1976 | Chia et al. | 148/2 |
| 4,028,141 | 6/1977 | Chia et al. | 148/2 |
| 4,080,222 | 3/1978 | Schoeiner et al. | 148/2 |
| 4,164,331 | 8/1979 | Henrich | 242/25 R |
| 4,183,771 | 1/1980 | Setzer et al. | 148/2 |
| 4,192,693 | 3/1980 | Chia et al. | 148/2 |

FOREIGN PATENT DOCUMENTS

| | | | |
|---|---|---|---|
| 53-3025217 | 8/1978 | Japan | 148/156 |

OTHER PUBLICATIONS

Sublett, "thermal Treatment Pertaining to Aluminum Production, " *Wire and Wire Products,* , vol. 40, No. 11, Nov. 1965, pp. 1766–1769, 1801–1803.

Sublett "Thermal treatment of Aluminum Wire for Mechanical Applications, " *Wire Technology,* , 11/12/77, pp. 45–49.

*Primary Examiner*—L. Dewayne Rutledge
*Assistant Examiner*—Christopher W. Brody
*Attorney, Agent, or Firm*—Herbert M. Hanegan; Terry Martin; Robert S. Linne

[57] ABSTRACT

An apparatus and method of storing a great length of continuously advancing elongate metallic material in a temperature controlled accumulator (40, 50) is disclosed to enable greater line speeds by exposing a greater length of material to the heat treatment. Several embodiments are disclosed in which heated cylindrical accumultor apparatus (40, 50) are used to store a multiplicity of wraps (45) around fixed or rotating cylinders (44, 51) which are maintained at the desired temperatures.

8 Claims, 4 Drawing Figures

APPARATUS FOR CONTROLLED TEMPERATURE ACCUMULATOR FOR ELONGATED MATERIALS

TECHNICAL FIELD

The present invention relates to the metallurgical arts, and more specifically to an improved method and apparatus for continuously heat treating metallic rod and wire or the like following working of the cast metal bar or billet.

BACKGROUND OF THE INVENTION

The present invention may be usefully applied to all metallic wires, including non-ferrous metals, but it is especially directed to aluminum and aluminum alloys. Improved aluminum alloy electrical conductors were developed and improved throughout the 1970's including Triple-E® for building wire and alloy 6201 for overhead conductors among many others. The especially useful properties of the various alloy conductors are generally achieved through combinations of working the metal and thermal treatments. It is to the latter manufacturing operation that this invention is directed.

Of the various thermal treatment by which the alloy rod or wire properties are achieved, this invention is most useful in the annealing of wire, but may also be used in homogenization, solution heat treating (or solutionizing), and precipitation treating (or aging) of wire or rod.

Annealing, the thermal treatment for which one embodiment of the present invention is particularly appropriate, is the heating of the alloy to about the recrystallization temperature and maintaining the desired temperature for a particular desired period of time, after which the alloy is cooled or quenched. Annealing is often used to soften metal by removal of stress resulting from cold working or by coalescing precipitates from solid solution.

Homogenization is a high temperature soaking treatment to eliminate or reduce segregation by diffusion, obtaining thereby a uniform structure and an even distribution of alloying constituents; it has been described as particularly applicable for those aluminum alloys having up to 12% alloying constituents. Often, homogenization consists of heating to near the eutectic melting point and maintaining this temperature for up to several hours. A stronger, more ductile (and homogeneous) structure may result if homogenization is properly performed.

Generally, the term "solution heat treating" is applied when an alloy is heated at a given temperature for a given time in order to allow soluble constituents to enter into solid solution, where they are retained in a supersaturated state after quenching. A solution heat treated aluminum alloy, suitably quenched and with subsequent treatments, can provide high mechanical properties such as tensile strengths greater than 90,000 $lbf/in^2$ and shear strengths of 50,000 $lbf/in^2$.

Precipitation treating, or aging, is of two types, natural (usually at room temperature) or artificial (usually at elevated temperatures). Aging gives certain alloys maximum strength and may be performed in coordination with certain solution heat treatment procedures. Aging comprises the precipitation of small particles from solid solution under controlled temperatures.

Various non-ferrous and especially aluminum products are used as electrical conductors, including EC (electrical conductor grade) and various alloys including Triple E®, Super T®, NiCo®, the Aluminum Association 1350, 5005, 6101, 6201 and others. Electrical conductivity standards from about 50 percent of IACS (International Annealed Copper Standard) to about 62% of IACS are common, depending on the alloy and use intended. Certain alloys, for example the proprietary Triple E aluminum conductor alloy, require careful preparation to achieve their most desirable properties. Ordinarily, high iron aluminum alloys may be manufactured continuously and certain production economies associated therewith are obtained; see for example U.S. Patent Number Re. 28,419 (Reissue of U.S. Pat. No. 3,512,221) and others of this family.

In producing many of these aluminum alloys, and especially the high-iron aluminum alloys such as Triple E, a continuous casting machine serves as a means to solidify the molten aluminum alloy metal into a cast bar product which is subsequently hot-formed into an elongated rod or other intermediate product. The hot forming may be used to impart substantial movement to the cast bar along a plurality of angularly disposed axes. For illustration but not limitation, the casting machine may be of the wheel/band type including a casting wheel having in the periphery thereof a groove partially closed by an endless band. The wheel and band cooperate to provide a mold, into one end of which molten metal is poured to solidify, and from the other end of which the cast bar is emitted in substantially that condition in which it was solidified. The cast bar is often conveyed directly into a rolling mill.

The rolling mill is of a conventional type having a plurality of roll stands arranged to hot-form the cast bar by a series of deformations. By rolling the cast bar substantially immediately upon extraction from the casting machine, the cast bar remains at a hot-forming temperature within a range of hot-forming temperatures. The cast bar may, however be adjusted by thermal treatment, as desired, by appropriate apparatus. The rolling mill reduces the bar cross section and elongates it to produce a rod product having a smaller cross section.

Rolled alloy rod such as is produced according to the foregoing is then processed in a reduction operation designed to produce continuous lengths of wire having various diameters, such as by drawing operations. Such drawing includes passing the rolled rod product through a successive series of progressively constricted dies to form the wire of desired diameter. Alternatively, the rod may be rolled down to smaller (wire) diameters. At the conclusion of the cross section reduction process, and intermediately during the process with certain alloys, the wire product is usually subjected to annealing or one of the foregoing thermal treatments to achieve a desired combination of properties. With certain alloy conductor materials such as Triple-E, the unannealed rod (F temper) is cold drawn without intermediate anneals, resulting generally in a wire product having very high tensile strength, and low conductivity and/or ultimate elongation properties.

Annealing may be performed in a batch furnace, or continuously, as by electrical resistance annealing, induction annealing, convection annealing, or radiation annealing. Among these thermal treatment operations, in-line continuous annealing is the most productive and energy efficient if carefully performed. Electrical resistance annealing, if possible, would be the most effective and easiest to accurately control, as is necessary to accommodate variations in line speed. Conventional apparatus, however, are unequal to the task as either unacceptably long catenaries of wire must be heated, unacceptably slow line speeds, or incompletely annealed wire results. Wire breakage due to high electrical current levels is a continuing problem at the high line speeds necessary for economic thermal treatments. This is especially true at line speeds above several thousand feet per minute or with small diameter wire.

DISCLOSURE OF INVENTION

The present invention solves these and other problems by the use of a special device to lengthen the duration of the thermal treatment applied to the rod or drawn wire and the added process step of holding the rod or wire at a selected elevated temperature for a selected time to ensure that the desired mechanical and electrical properties are achieved in the finished wire product. This is accomplished by storing a portion of the continuously advancing wire product about a cylindrical accumulator. With most electrical conductor grade alloys there is a range of temperature/time relationships during which a given size wire of the particular alloy will reach the desired characteristics. With high-iron alloys, and especially with Triple-E alloy (from about 0.3 to about 0.95 weight-percent iron) temperature range of from about 650° F. to about 850° F. for a time of from about 60 seconds to about 10 seconds, respectively, has been determined appropriate for annealing. At higher temperature and/or longer periods conductivity and/or strength decreases, probably due to the iron going back into solution, while at lower temperatures and/or shorter periods the conductivity and/or elongation will not be acceptable.

BEST MODE FOR CARRYING OUT THE INVENTION

Figure 1:
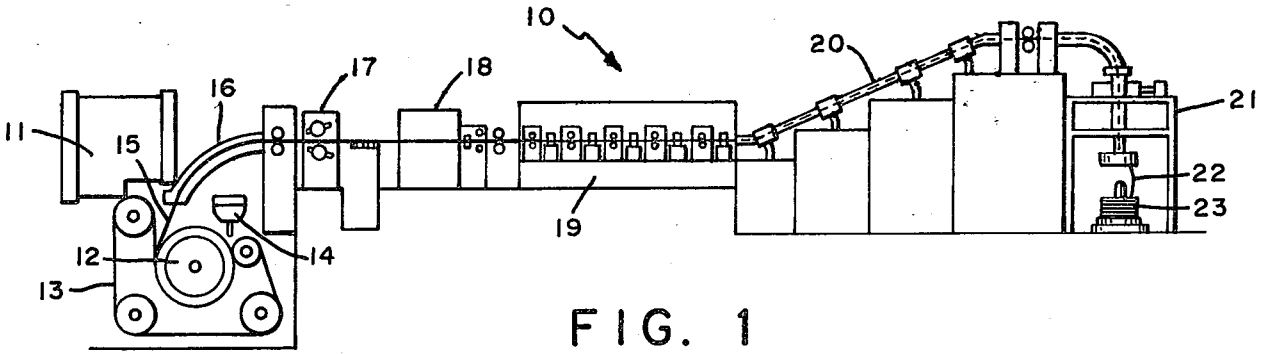
FIG. 1 is a simplified diagram of an exemplary system for continuous casting and rolling of molten metals, which may include heat treatments of the solidified metal at various stages in the production process (not shown).

Referring to FIG. 1, a continuous casting and rolling apparatus 10 is shown, in which molten metal is supplied to pour pot 14 by melting/holding furnace 11, poured into a mold formed by a peripheral groove in a rotating casting wheel 12 and casting band 13. Coolant (not shown) is applied to the closed portion of the mold to solidify the molten metal, forming a cast bar 15, which is guided by cast bar conveyor 16 away from the casting machine to subsequent operations. Shear 17 may be used to sever sections of the cast bar 15, as may be required during ordinary manufacturing operations. The cast bar 15 is routed through prerolling station 18 which may contain an initial bar heat treatment apparatus (not shown) and is then directed into the rolling mill 19, in which a plurality of roll stations work the metal, reducing its cross section and elongating it. Delivery pipe 20, in which thermal treatment may be performed, guides the thus-formed continuous cast and rolled rod product to a coiler station 21, where the rod 22 is collected into coils 23 for convenient handling, and storage or shipping.

The rod is then further reduced in cross section and lengthened into a smaller elongated product such as wire, as by drawing it in a conventional drawing machine or rolling in a conventional micro-mill. The metal may be subjected to various intermediate thermal treatments while being reduced in cross section.

Figure 2:
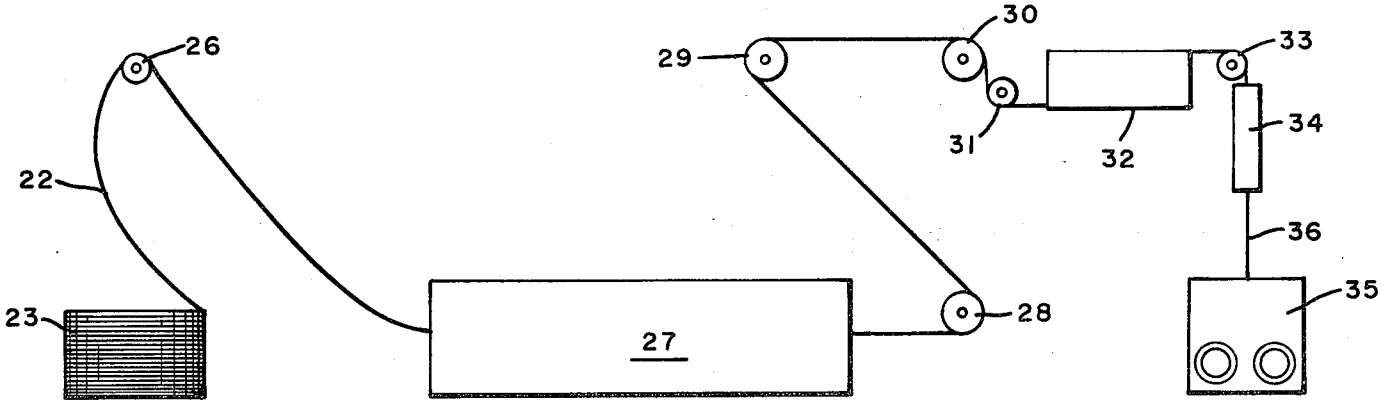
FIG. 2 is a simplified schematic view of the present invention added to a conventional drawn wire processing line.

Rod produced by the continuous casting and rolling apparatus 10 of FIG. 1, or otherwise, is further reduced in cross section by drawing or further rolling in a micro-mill, then annealed, quenched and coiled or spooled, see FIG. 2. Rod 22 is unwound from a coil 23 and continously advanced along a predetermined path, which includes an overhead guide roll 26 which serves to prevent kinks in the unwinding rod 22. The rod is advanced to and through drawing machine 27 to reduce the cross section thereof to the desired wire diameter, then directed to and partially around guide sheave 28, following which it is advanced to an annealing apparatus comprising first annealer contact sheave 29 by means of which electrical contact is made to a first electrical current source, and second annealer contact sheave 30 which is spaced apart from first annealler contact sheave 29. Sheave 30 completes the electrical circuit to a second electrical current source through the wire, which heats up by electrical resistance heating effects. The wire is advanced to and partially around guide roll 31 and directed to the controlled temperature accumulator, the object of this invention, where the wire is held at a desired temperature for a particular predetermined time period so as to achieve the desired electrical and mechanical properties. Following the thermal treatment the wire is quenched in a conventional quench unit 34. The annealed, quenched wire 36 is then directed to a spooler for convenient handling in subsequent operations.

Figure 3:
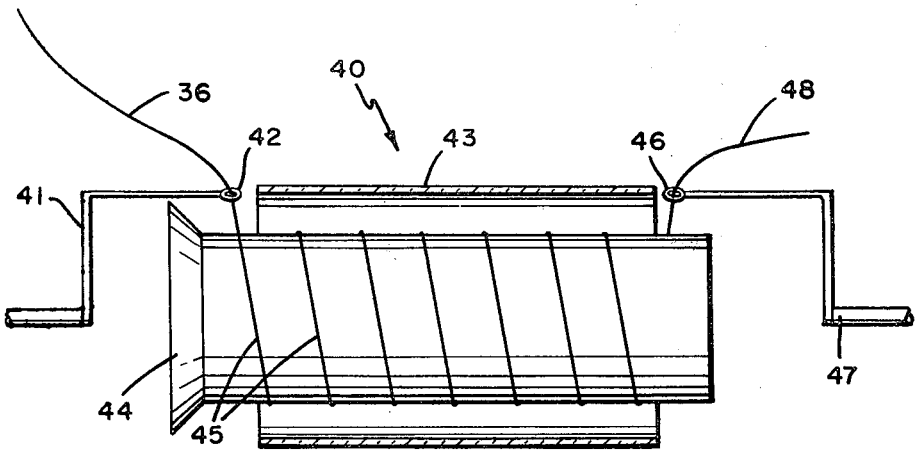
FIG. 3 is illustrative of one embodiment of accumulator apparatus claimed in this invention.
Figure 4:
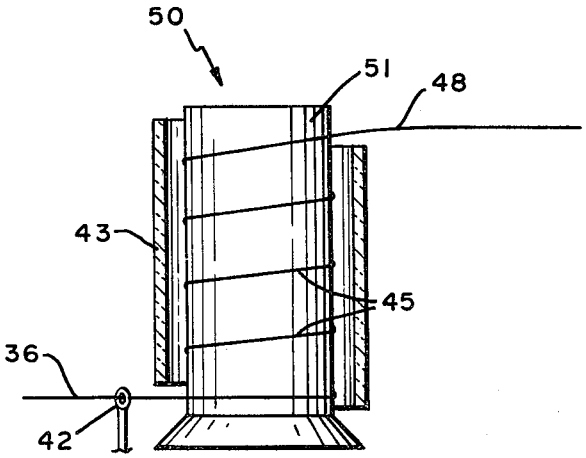
FIG. 4 is illustrative of a second embodiment of apparatus claimed in this invention.

FIGS. 3 and 4 present more detailed, alternate embodiments of accumulator 32 of FIG. 2. In FIG. 3, a slightly tapered horizontal drum 44 with associated wire guide mechanisms form the controlled temperature accumulator 40. The drum may be a rotated. Preheated advancing wire 36 is directed onto the moving surface of horizontal rotating tapered drum 44 through input wire guide 42 mounted on input flyer 41, which is rotatable about the periphery of drum 44. The drum is heated to a value within a predetermined range of thermal treatment temperature values, and may be maintained for example by conventional thermostatic controls. Around the drum 44 are wrapped a multiplicity of turns 45 of wire as determined by the rotational speed and the length of further heat treatment desired for the particular metal or alloy being treated. Output wire guide 46 directs the removal of the wire from the surface of the drum, assisted by output flyer 47 on which it is mounted. Output flyer 47 is rotatable about the periphery of drum 44. The fully heated wire 48 departs the apparatus 40 for further processing operations such as quenching, aging and/or coiling. An insulated cover 43 retains the heat dissipated by drum 44 which is maintained at the desired temperature by conventional means (not shown). The drum may be rotated by conventional drive means or by the advancing wire.

In FIG. 4 an alternate embodiment of apparatus of the present invention is shown, and in which the controlled temperature accumulator 50 comprises a vertical rotating heated drum 51 with associated wire guide mechanisms. In FIG. 4, a preheated wire 36 is guided onto the drum 51 through input wire guide 42 forming a plurality of wraps 45 therearound and exiting as fully heated wire 48 for further operations as desired. An insulated cover 43 retains the heat dissipated by drum 44 which is maintained at the desired temperature by conventional means (not shown).

INDUSTRIAL APPLICABILITY

The present invention is most useful in replacing or adapting existing thermal treatment apparatus for high speed, continuous wire use wherein the thermal treatment accorded a wire product, especially an aluminum, aluminum alloy, or other metallic wire may be carefully regulated to optimize the electrical and mechanical properties of the wire.

I claim:

1. High speed thermal treatment apparatus for a continously variable length of a continously advancing elongated metallic wire material comprising:

a. a cylinder having an outer surface, a proximal first end, a distal second end, and a longitudinal axis;

b. a predetermined path for the continously advancing elongated metallic wire material which includes a helical path formed by a continuously variable number of wraps circumferentially contacting said cylinder surface beginning adjacent the proximal end thereof and concluding adjacent the distal end thereof, c. means to rotate the cylinder about its longitudinal axis, d. heat source means for heating said cylinder to a temperature value within a range of predetermined thermal treatment temperature values, e. first guide means for adding a variable number of wraps around the cylinder by directing the continously advancing elongated metallic material tangentially into contact with the cylinder surface at the proximal end thereof, and f. second guide means for removing a variable number of wraps from around the cylinder by directing the continuously advancing elongated metallic material (tangently) tangentially away from the cylinder surface at the distal end thereof.

wherein the length of wire wrapped around the accumulating cylinder is continously variable by rotation of said first and second guide means about the cylinder axis.

2. In an apparatus for the thermal treatment of a continously variable length of continously advancing elongated metallic wire material following a predetermined path which includes means for elevating the temperature of said elongated metallic wire material, the improvement in combination therewith including a thermal treatment accumulator apparatus comprising:

a. a cylinder having a proximal first end, a distal second end, and a longtitudinal axis, b. a predetermined path for the continuously advancing elongated metallic wire material which includes a helical path formed by a continuously variable number of wraps circumferentially contacting said cylinder beginning adjacent the proximal end thereof and concluding adjacent the distal end thereof, c. means to rotate the cylinder about its longitudinal axis, d. heat source means for heating the wire wrapped around said cylinder to a temperature value within a range of predetermined thermal treatment temperature values, e. first guide means for continuously adding a variable number of wraps around the cylinder by directing the continuously advancing elongated metallic material (tangently) tangentially into contact with the cylinder at the proximal end thereof, and f. second guide means for continuously removing a variable number of wraps from around the cylinder by directing the continuously advancing elongated metallic material (tangently) tangentially away from the cylinder at the distal end thereof.

3. Apparatus as in claims 1 or 2 wherein the cylinder is rotatable about its longitudinal axis and further including:

(d) drive means for rotating the cylinder about the longitudinal axis thereof.

4. Apparatus as in claims 1 or 2 wherein the cylinder is slightly tapered from the proximal first end thereof to the distal second end thereof.

5. Apparatus as in claims 1 or 2 wherein the cylinder has a tapered flanged proximal first end tapering slightly towards the distal second end thereof.

6. Apparatus as in claims 1 or 2 further characterized in that the first guide means is a rotatable arm having a pivotably fixed first end coaxial with the cylinder axis and a free arm end having a first guide means on the free arm end thereof, said first guide means scribing a peripheral path around the surface of and spaced apart from the proximal first end of the cylinder and the second guide means is a rotatable arm having a pivotably fixed first end coaxial with the cylinder axis and a free arm end having a second guide means on the free arm end thereof, said second guide means scribing a peripheral path around the surface of and spaced apart from the distal second end of the cylinder.

7. Apparatus as in claims 1 or 2 further characterized in that the longitudinal axis of the cylinder is vertical.

8. Apparatus as in claims 1 or 2 further characterized in that the longitudinal axis of the cylinder is horizontal.

* * * * *